United States Patent [19]

Nelson

[11] Patent Number: 4,643,017

[45] Date of Patent: Feb. 17, 1987

[54] PRESS HAVING NOVEL GUIDE BARS

[76] Inventor: Richard E. Nelson, 53 E. Tacoma, Clawson, Mich. 48017

[21] Appl. No.: 820,061

[22] Filed: Jan. 21, 1986

Related U.S. Application Data

[62] Division of Ser. No. 591,124, Mar. 19, 1984, Pat. No. 4,580,436.

[51] Int. Cl.[4] ..... B21J 13/00

[52] U.S. Cl. ..... 72/446; 72/418; 72/455; 72/456

[58] Field of Search ..... 72/418, 446, 448, 455, 72/456, 462, 481; 100/214, 228, 238; 83/637

[56] References Cited

U.S. PATENT DOCUMENTS

| | | | |
|---|---|---|---|
| 2,339,959 | 1/1944 | Stadlin | 72/418 |
| 2,869,177 | 1/1959 | Jurgeleit | 72/456 |
| 3,154,009 | 10/1964 | Dewyer | 100/214 |
| 3,470,728 | 10/1969 | Polidori | 72/456 |
| 3,641,929 | 2/1972 | Ballard | 100/233 |
| 3,651,754 | 3/1972 | Forest | 100/91 |
| 4,329,867 | 5/1982 | Nelson | 72/455 |

*Primary Examiner*—Lowell A. Larson
*Assistant Examiner*—Robert Showalter
*Attorney, Agent, or Firm*—Basile, Weintraub & Hanlon

[57] ABSTRACT

A four bar linkage is movable from a first position to a second position by a continuous motion of a linear actuator. The linkage comprises a first leg and a second leg shorter than the first leg spaced from and parallel to the first leg in the first position. The first and second legs are supported at their lower end by being pivotally attached to a base, and the upper ends of the first and second legs pivotally support an upper platen at their upper end. The first and second legs, the base, and the upper platen comprise the elements of a four bar linkage. The linkage is translated from a first position where the first and second legs are parallel and extend vertically upward to a second position wherein the platen is rotated up to 90° or more and is displaced laterally from the base and can face to the side and upward allowing access to the base and the upper platen from overhead.

2 Claims, 5 Drawing Figures

PRESS HAVING NOVEL GUIDE BARS

This application is a division of application Ser. No. 591,124, filed 3-19-84, now U.S. Pat. No. 4,580,436.

BACKGROUND OF THE INVENTION

1. Field of the Invention

The present invention generally relates to the field of actuators for four bar linkages and, in particular, the present invention is concerned with actuators for translating the linkage of an articulating frame press from a first position to a second position.

2. Description of the Prior Art

Linear actuators for translating a four bar linkage from one position to another, as applied in presses, are known. U.S. Pat. Nos. 3,154,009; 3,651,754; and 3,641,929 disclose a linear actuator for translating the motion of a press with an articulating frame from one position to another. These devices all employ a press frame that has opposed links, or legs of equal length, with the legs remaining parallel to their opposed legs throughout the translation of the press frame from one position to another. This parallelogram configuration makes it relatively simple to attach one end of a linear actuator such as a cylinder to the base and another end of the cylinder to a link of the frame and actuate the frame from one position to another with a continuous linear motion of the actuator. My invention U.S. Pat. No. 4,329,867 discloses an articulating frame press which comprises a four bar linkage having legs of uneaqual length. In U.S. Pat. No. 4,329,867 a rotary actuator was disclosed for translating the press from a first position to a second position. To articulate the press or translate from a first position to a second position, utilizing a rotary actuator such as a rack and pinon or hydraulic motor, it is necessary that the rotary actuator reverse its motion at a point between the first position and the second position because the rotary motion of the legs, relative to the base, is reversed during the translation. This requires a sophisticated control for the rotary actuator so that at a precise position of the frame the motion of the rotary actuator is reversed. This adds complication and expense. In the present invention, a linear actuator is interconnected between opposing links of a four bar linkage so that when one link has reversed its motion and is rotating toward the opposed link, the opposed link is continuing its rotation toward the one link at a sufficient rate to exceed the rate of rotation of the one link and allow actuation of the four bar linkage with a continuous motion of the linear actuator.

3. Information Disclosure Statement

The aforementioned prior art including the applicant's U.S. Pat. No. 4,329,867 in the opinion of the applicant and the applicant's attorney, represents the closest prior art and/or information of which the applicant and his attorney are aware.

SUMMARY OF THE INVENTION

The present invention, which will be described in greater detail hereinafter, comprises a press for forming complimentary parts, the press having a frame consisting of a four bar linkage which is translatable from a first position to a second position. The frame comprises a base, a first pair of spaced apart legs having an upper end and a lower end with the lower end of the legs pivotally supported by the base. The second pair of spaced apart legs are positioned a distance from the first pair of spaced apart legs. The second pair of spaced apart legs are shorter than the first pair of legs and have their lower end pivotally supported by the base. An upper platen is pivotally supported by the upper end of the first pair and second pair of legs. The base, the first pair of legs, the second pair of legs, and the upper platen comprise the frame of the press which is translatable from a first position, with the legs extending vertically upward, to a second position wherein the upper platen has been translated laterally to a position at the side of the base and facing slightly upward. In the second position, the base and the platen are accessible from overhead without obstruction.

The present invention includes a linear actuator pivotally secured at one end to one of the first pair of legs and at another end to one of the second pair of legs so that the press frame can be articulated from the first position to the second position with a continuous non reversing linear motion of the actuator.

It is therefore a primary object of the present invention to provide a new and improved linear actuator for an articulating frame press.

It is a further object of the present invention to provide a linear actuator for an articulating frame press that translates the frame from one position to another position with a continuous linear motion.

It is an additional object of the present invention to provide a booster cylinder to assist the actuator when the articulating frame is in its maximum overhung position.

Further objects, advantages, and applications of the present invention will become apparent to those skilled in the art to which this invention pertains, when the accompanying description of one example of the best mode contemplated for practicing the invention is read in conjunction with the accompanying drawing.

DESCRIPTION OF THE DRAWING

In the drawing, like reference numbers refer to like parts throughout the several views and wherein.

DESCRIPTION OF THE PREFERRED EMBODIMENT

Figure 1:
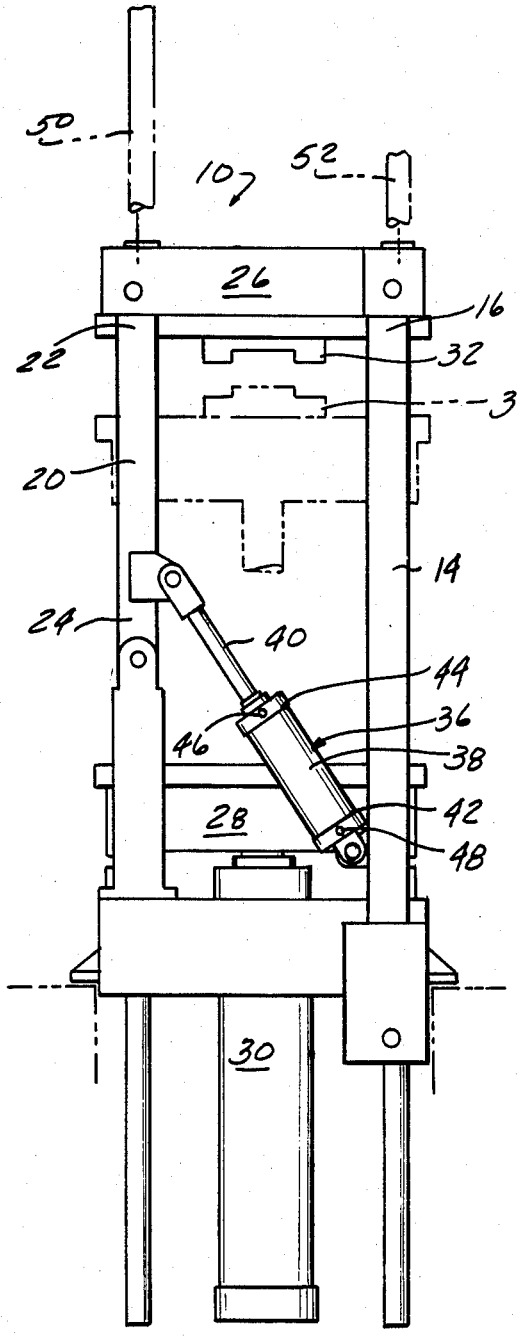
FIG. 1 illustrates a side view of an articulating frame press utilizing a linear actuator of the present invention.

Referring now to the drawing, there is illustrated in FIGS. 1 through 4 one example of the present invention in the form of an articulating frame press 10 for forming complimentary parts. The press 10 is translatable from a first position illustrated in FIG. 1 to a second position which will be described in greater detail hereinbelow. The frame of the press 10 comprises a base 12 which rests on the floor, a first pair of spaced apart legs 14 having an upper end 16 and a lower end 18 with the lower end 18 pivotally supported by the base 12. A second pair of spaced apart legs 20 are provided having an upper end 22 and a lower end 24 pivotally attached to the base of their lower end. An upper platen 26 comprises a third leg which is pivotally supported by the upper ends 16 of a first pair of legs 14 and the upper end 22 of the second pair of legs 20. The base 12, the first pair of legs 14, the second pair of legs 20, and the third leg or upper platen 26 comprise the frame of the articulating frame press 10. The press 10 includes a lower platen 28 which is carried by the base and is movable between the base 12 and the upper platen 26 by means of a press cylinder 30. A die is provided having an upper part 32 attached to the upper platen 26 and a lower part 34 attached to the lower platen 28. When the lower platen 28 is moved to a working relationship with the upper platen 26 the upper and lower parts of the die are brought together and form a complimentary part therebetween.

Figure 4:
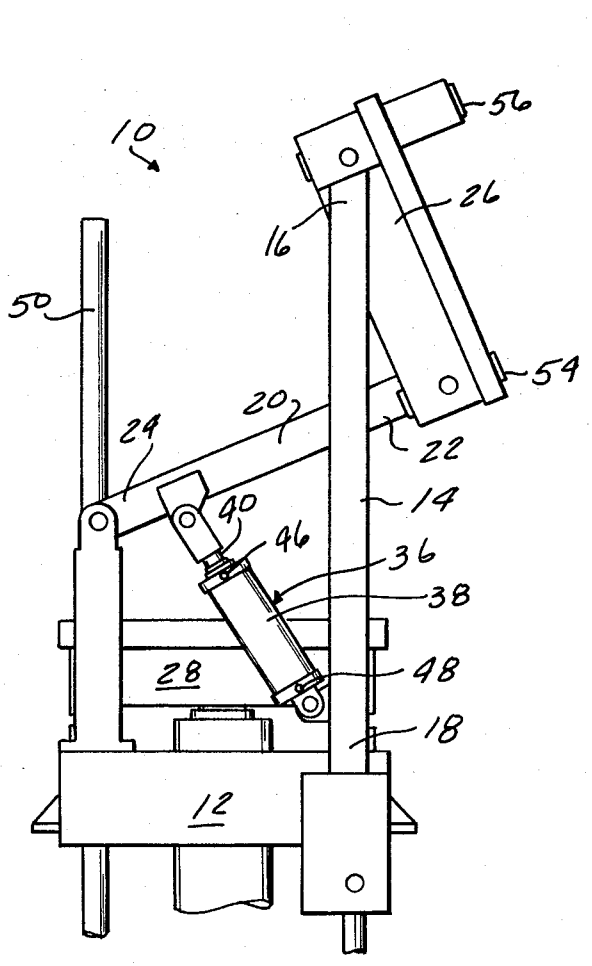
FIG. 4 illustrates the press of FIG. 1 with the frame articulated fully to the second position.

The press 10 is translatable from a first position as shown in FIG. 1 to a second position as shown in FIG. 4 by means of a linear actuator 36. When the press 10 is in its first position the upper and lower parts of the die 32, 34 are in alignment and can produce complimentary parts when material is inserted between the die parts and the lower platen 28 approaches the upper platen 26 squeezing the marterial between the die parts. When the press frame 10 has been translated to the second position as shown in FIG. 4 of the drawing, the upper platen 26 has been rotated in a counter clockwise direction approximately 112° and displaced transversely, relative to the lower platen 28, which places the upper platen 26 at the side of the press facing slightly upward. This allows overhead access to the upper platen 26 and the lower platen 28 allowing the upper and lower parts of the die to be installed, replaced, or worked on simultaneously.

The press 10 is translatable from the first position shown in FIG. 1 of the drawing to the second position shown in FIG. 4 of the drawing by means of the linear actuator 36. In a preferred embodiment the linear actuator 36 comprises a hydraulic cylinder 38 having a piston movable within the cylinder and a rod 40 attached to the piston. The rod 40 extends from the cylinder, or is retracted into the cylinder, to generate a linear motion. Inserting fluid into a rod end port 46 causes the linear actuator 36 to retract, and porting fluid into a cylinder end port 48 causes the rod 40 to extend and thus, the linear actuator 36 to extend. In the preferred embodiment the linear actuator 36 is pivotally attached at one end to the first leg 14 at a point spaced from the first leg lower end 18, and pivotally attached at another end to the second leg 20 at a point spaced from the second leg lower end 24. In the first position of the press 10, as shown in FIG. 1, the linear actuator 36 is extended, and retracting of the linear actuator causes the linkage to translate from the first to the second position.

Figure 2:
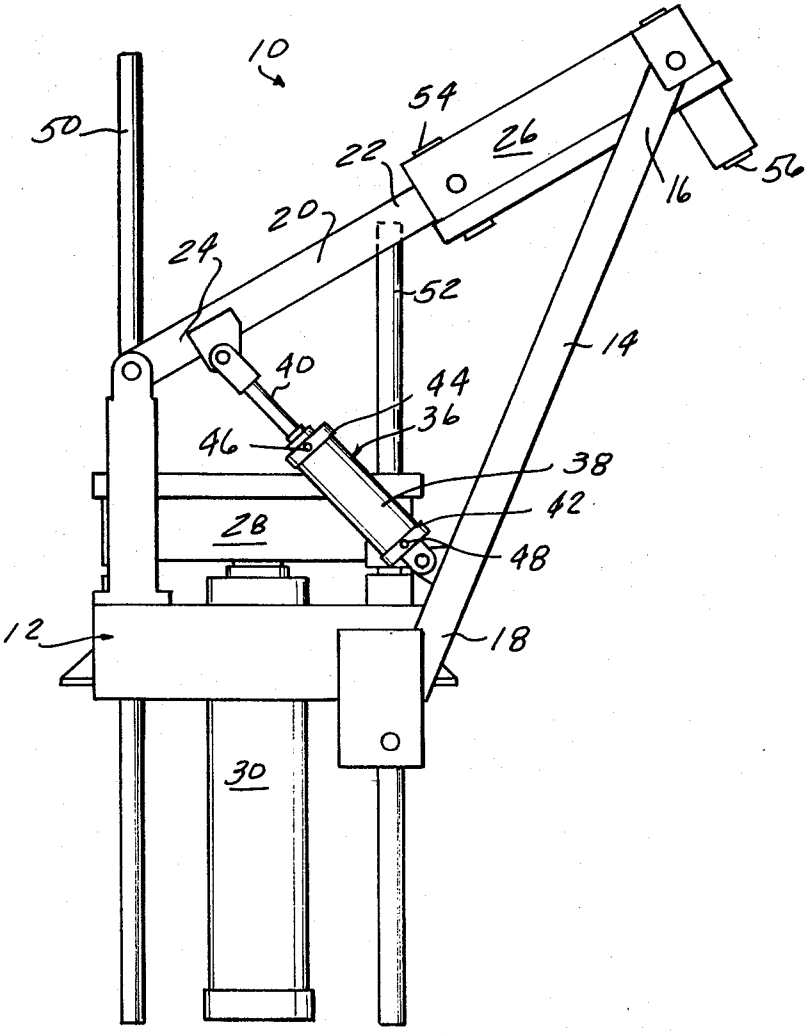
FIG. 2 illustrates the beginning of articulation of the frame press from the position shown in FIG. 1.

FIG. 2 of the drawing illustrates the press 10 articulated to an intermediate position between the first position and the second position wherein the second leg 20 and the upper platen 26 extend in a straight line which rotates the first leg 14 clockwise to a maximum angle about its lower end 18. If the press 10 is articulated in either direction from the position shown in FIG. 2 either toward the first position or toward the second position, the first leg 14 will rotate counter clockwise about its lower end 18. It can be seen that in articulating press 10 from its first position shown in FIG. 1 to the second position shown in FIG. 4 that the first leg 14 first rotates clockwise about its lower end 18 to the position shown in FIG. 2, and then rotates counter clockwise to the vertical position shown in FIG. 4 of the drawing upon completion of the articulation of press 10 from the first position to the second position.

Figure 3:
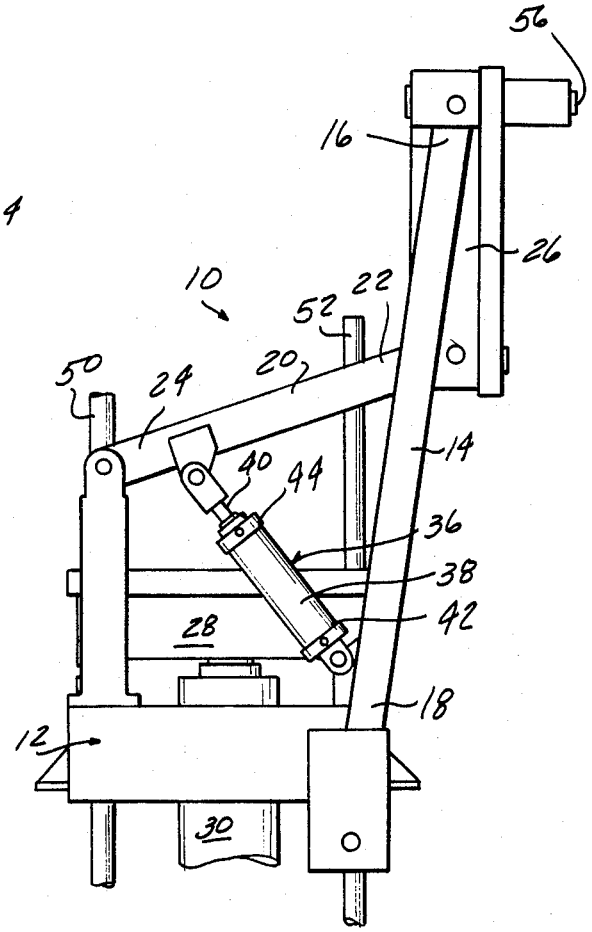
FIG. 3 illustrates further translation of the press articulating frame press with the upper platen shown in a vertical position.

FIG. 3 of the drawing illustrates a second intermediate position between the first position illustrated in FIG. 1 of the drawing and the second position illustrated in FIG. 4 of the drawing wherein the upper platen 26 is in a vertical position and the second leg 20 has rotated in a clockwise direction to its maximum position and, any translation from the position shown in FIG. 3, either toward the first position or the second position, induces a counter clockwise rotation of the second leg 20 about its lower end 24. As the press frame is translated from the position shown in FIG. 3 to the position shown in FIG. 4, only a small amount of counter clockwise rotation of the second leg 20 is encountered, while a substantially greater amount of angular movement of the first leg 14 is required. Consequently, while the counter clockwise movement of the second leg 20, between the position shown in FIG. 3 and the position shown in FIG. 4, would require an extension of the linear actuator 36, the angular motion of the first leg, between the position shown in FIG. 3 and the position shown in FIG. 4, requires a substantially greater amount of linear contraction of the linear actuator 36, so that the net result of the frame articulation between the position shown in FIG. 3 and the position shown in FIG. 4 requires a net contraction of the linear actuator 36.

When the press 10 is articulated from its first position, shown in FIG. 1, to the intermediate position, shown in FIG. 3, it can be shown, by careful study of the drawing, that the angular rotation of the second leg 20, between the first position and the position shown in FIG. 3, is substantially greater than the angular rotation of the first leg 14 so that the clockwise rotation of the first leg 14, in translating from the position shown in FIG. 1 to the position shown in FIG. 2, is offset by the greater angular rotation of the second leg 20 about its lower end 24 which results in a continuous net contraction of the linear actuator 36 in translating the press frame from the position shown in FIG. 1 to the position shown in FIG. 2. Consequently, a continuous contraction of the linear actuator 36 causes a smooth translation of the press 10 from the position shown in FIG. 1 to the position shown in FIG. 2 and to the position shown in FIG. 3 of the drawing. Translation of the press 10 from the position shown in FIG. 3 to the second position as shown in FIG. 4 of the drawing requires only a slight counter clockwise rotation of the second leg 20 about its lower end 24, while a substantially greater amount of angular rotation of the first leg 14 about its lower end 18 is required. While counter clockwise rotation of the second leg 20 about its lower end 24 requires an extension of the linear actuator 36 this tendency is more than offset by the greater angular rotation of the first leg 14 about its lower end 18, requiring a greater amount of linear contraction of the linear actuator 36 resulting in a net contraction of the linear actuator 36 between the position shown in FIG. 3 and the position shown in FIG. 4. Consequently, a contraction of the linear actuator 36 results in a smooth translation of the press 10 from its first position shown in FIG. 1 of the drawing to the position shown in FIG. 4 of the drawing.

As can be best shown in FIG. 2 of the drawing, a pair of guide rods 50, 52 are secured to the lower platen 28. These guide rods 50, 52 engage a pair of guide bushings 54, 56 as the platen 28 moves upward. These guide rods 50, 52 and guide bushings 54 56 serve to align the upper and lower platens and to precisely align the die upper part 32 with the die lower part 34 to form a precision part. It can be seen that if the guide rod 52 were the same length as the guide rod 50 the upper platen 26 would strike the guide rod 52 as the press frame is translated from the position shown in FIG. 1 to the position shown in FIG. 2 of the drawing. To avoid a collision between the upper platen 26 and the guide rod 52, the guide rod 52 is shortened to provide the necessary clearance. To avoid having a large gap between the bushing 56 and the end of the guide rod 52, the bushing 56 is positioned below the platen 26 as shown.

Figure 5:
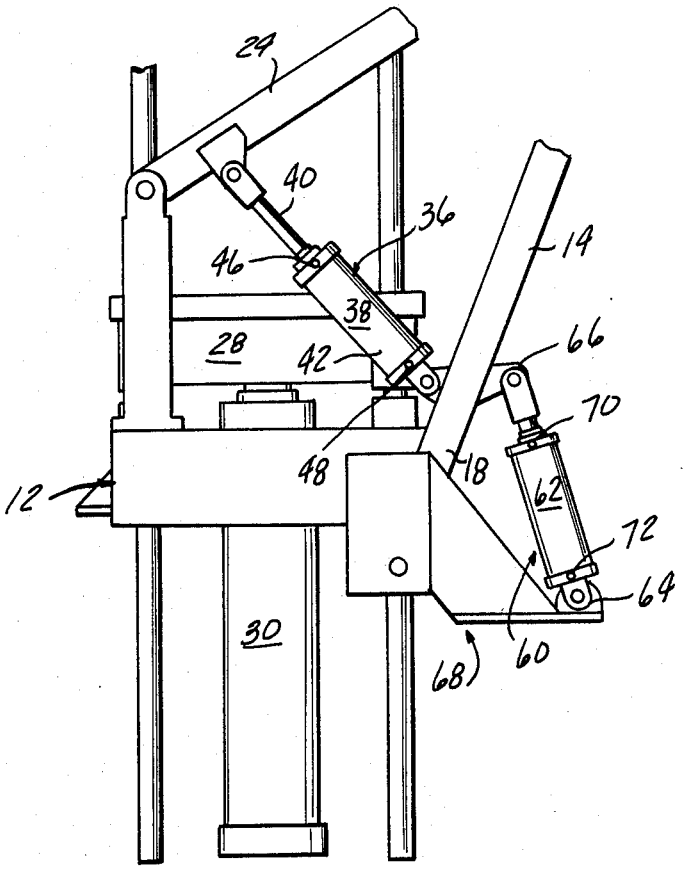
FIG. 5 illustrates a broken side view of the articulating frame press of FIG. 2 with a booster cylinder provided.

The force required to articulate the frame 10 can be determined by the amount of overhung load generated by the transverse translation of the upper platen 26. Examination of the various figures of the drawings shows that in FIG. 2 the platen 26 is translated transversely to its maximum position. In the position shown in FIG. 2, the maximum amount of pressure in cylinder 38 is required to actuate the press from one position to another. FIG. 5 of the drawing illustrates a booster means 60 which can be employed to assist in the actuation of the press when a heavy die upper part 32 is employed. The addition of the booster means 60 substantially reduces the size and operating pressure required in the hydraulic cylinder 38. The booster means 60 comprises a booster cylinder 62 having a cylinder end 64 pivotally attached to the base 12 by means of a base extension 68. The booster cylinder 62 further includes a rod end 66 pivotally secured to one of said pair of spaced legs 14 at the lower end 18. When a light die upper part 32 is secured to the upper platen 26 and the force required to articulate the frame is light, the booster cylinder 62 can be rendered inactive by hydraulically interconnecting the rod end port 70 with the cylinder end port 72 and thus, the full actuation of the press frame is controlled by the hydraulic cylinder 38. When a heavy die upper part 32 is employed and the pressure becomes excessive in the cylinder 38 the cylinder 62 can be actuated by applying pressure to cylinder port 72 and thus, the actuating pressure in hydraulic cylinder 38 can be substantially reduced.

It can thus be seen that the present invention has provided a new and improved device for actuating an articulating frame press from a first position wherein the platens are aligned to a second position wherein the upper platen is displaced transversely from the lower platen, allowing the upper and lower platens to be reached from overhead without obstruction. It is also apparent, to those skilled in the art of the kinematics of four bar linkages, that a new and improved actuator is provided for four bar linkages which allows actuation of the linkage from a first position to a second position utilizing a linear actuator, and requiring only a continuous uni-directional actuation of the actuator to achieve the translation from the first position of the linkage to a second position of the linkage.

It should be understood by those skilled in the art of articulating frame presses and four bar linkages that other forms of the applicant's invention may be had, all coming within the spirit of the invention and the scope of the appended claims.

Having thus described my invention what I claim is:

1. In a press for forming a work piece; the press comprising a base, a first platen supported by the base, a movable platen carried by the base and movable between a first position adjacent the base and a second position adjacent the first platen, the invention comprising:

a plurality of guide rods each having a free end, said guide rods movable with and carried by the movable platen;

guide bushings carried by the first platen, said guide bushings positioned to receive said guide rods and align the first and movable platens as the movable platen is moved toward the first platen;

wherein when the movable platen is in the first position said guide rods are disengaged from said guide bushings.

2. The press as defined in claim 1 wherein certain of said guide rods are of an unequal length.

* * * * *